United States Patent [19]

Lajovic

[11] 4,441,426

[45] Apr. 10, 1984

[54] PRINTING APPARATUS

[76] Inventor: Dusan S. Lajovic, Cnr. Victoria & O'Connell Sts., Smithfield 2164, Australia

[21] Appl. No.: 356,301

[22] Filed: Mar. 10, 1982

Related U.S. Application Data

[63] Continuation of Ser. No. 139,265, Apr. 11, 1980, abandoned.

[30] Foreign Application Priority Data

Apr. 17, 1979 [AU] Australia ..... PD8427

[51] Int. Cl.[3] ..... B41F 13/08

[52] U.S. Cl. ..... 101/376; 101/38 R; 101/218; 101/247; 29/117

[58] Field of Search ..... 118/205, 216, 218; 101/38 R, 38 A, 39, 212, 247, 40, 375, 376; 29/117

[56] References Cited

U.S. PATENT DOCUMENTS

| | | | |
|---|---|---|---|
| 598,107 | 2/1898 | Moody | 29/117 |
| 2,583,889 | 1/1952 | Schoonenberg | 101/375 |
| 3,188,950 | 6/1965 | Kelly | 101/375 |
| 3,200,742 | 8/1965 | Kasermann | 101/38 R X |
| 3,234,874 | 2/1966 | Hornberger et al. | 101/218 |
| 3,250,213 | 5/1966 | Brigham et al. | 101/40 |
| 3,261,281 | 7/1966 | Hartmeister | 101/40 X |
| 3,537,394 | 11/1970 | Swapp | 101/376 X |
| 3,593,662 | 7/1971 | Gates | 101/247 X |
| 3,695,176 | 10/1972 | Van Der Roer | 101/376 |
| 3,894,488 | 7/1975 | Gazzola | 101/247 X |

FOREIGN PATENT DOCUMENTS

| | | | |
|---|---|---|---|
| 826890 | 4/1938 | France | 101/376 |
| 1345383 | 10/1963 | France . | |
| 2066519 | 8/1971 | France . | |
| 1604984 | 6/1972 | France . | |
| 1027473 | 4/1966 | United Kingdom . | |
| 1047222 | 11/1966 | United Kingdom . | |
| 1183782 | 3/1970 | United Kingdom . | |
| 1291915 | 10/1972 | United Kingdom . | |
| 1292402 | 10/1972 | United Kingdom . | |

*Primary Examiner*—Edgar S. Burr
*Assistant Examiner*—Charles A. Pearson
*Attorney, Agent, or Firm*—Stevens, Davis, Miller & Mosher

[57] ABSTRACT

Printing apparatus is disclosed comprising a rotatably mounted hub, a plurality of carriages circumferentially spaced around the hub, each carriage being adapted to support a printing blanket. Each carriage is movable with respect to the hub upon actuation to retract its respective blanket radially out of its operative printing position.

4 Claims, 3 Drawing Figures

PRINTING APPARATUS

This is a continuation of application Ser. No. 139,265 filed Apr. 11, 1980, now abandoned.

The present invention is applicable to printing apparatus and, in particular, provides an improvement in apparatus for continuously printing onto each of a series of articles.

One application for the present invention is in apparatus such as that disclosed in the specification of our U.S. Pat. No. 4,055,142 which illustrates apparatus which can be used to perform successive coating and printing functions on a series of extruded tubes located on concentric arrays of mandrels on a rotating turret. The disclosure in U.S. Pat. No. 4,055,142 is included herein by way of reference. It will be appreciated, however, that while the present invention may be well suited to this particular application, it is not limited to this field.

When printing on a succession of articles in applications such as that illustrated in U.S. Pat. No. 4,055,142, it is frequently necessary to avoid a print application if, for example, one of the articles is damaged or absent from the series.

In the past, it has been known to retract the entire printing drum or to stop its rotation entirely. Both of these methods have encountered substantial problems with mechanical inertia. In high speed operations such as can-making, where articles are processed at some 800 per minute, the retraction or stopping of the drum frequently allows a significant number of articles to avoid the printing function unnecessarily to simply to accommodate one defective or absent article. Furthermore, if one or more printing cycles is omitted, the printing blanket generally builds up an excess quantity of ink with the result that subsequent printing may be initially unsatisfactory.

The present invention provides a simple solution to these problems by mounting one or more printing blankets on retractible carriages such that the blanket is radially retractible relative to the printing drum. The printing blanket can then be retracted out of printing engagement for one cycle if required, without stopping or retracting the drum itself.

According to the invention there is provided printing apparatus comprising a rotatably mounted hub, a plurality of carriages circumferentially spaced around said hub, each carriage being adapted to support a printing blanket thereon, each said carriage being movable with respect to said hub upon actuation to retract its respective blanket radially out of its operative printing position.

A preferred embodiment of the invention will now be described, by way of example only, with reference to the accompanying drawings in which.

Figure 1:
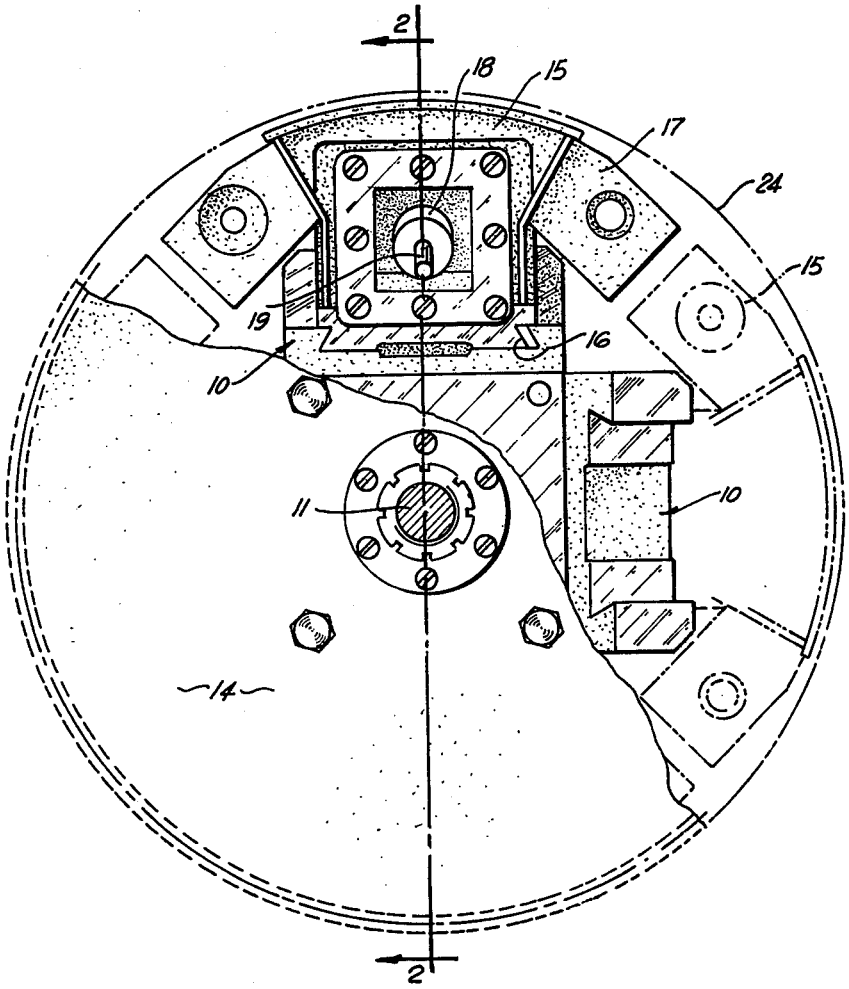
FIG. 1 is a partly sectioned axial end elevation of printing apparatus according to the invention.

Referring to the drawings, a hub 10 is rotatably mounted to a shaft 11 by bearings 12 and 13. The hub is rotatably driven by a gear 14 fixedly secured to it. Spaced around the periphery of the hub are four carriages 15 each of which is axially radially slidable relative to the hub along inclined slideways 16. Each carriage includes a pair of brackets 17 for securing a printing blanket (not shown) to the carriage. Thus the individual blankets can be removed and replaced as required.

Figure 2:
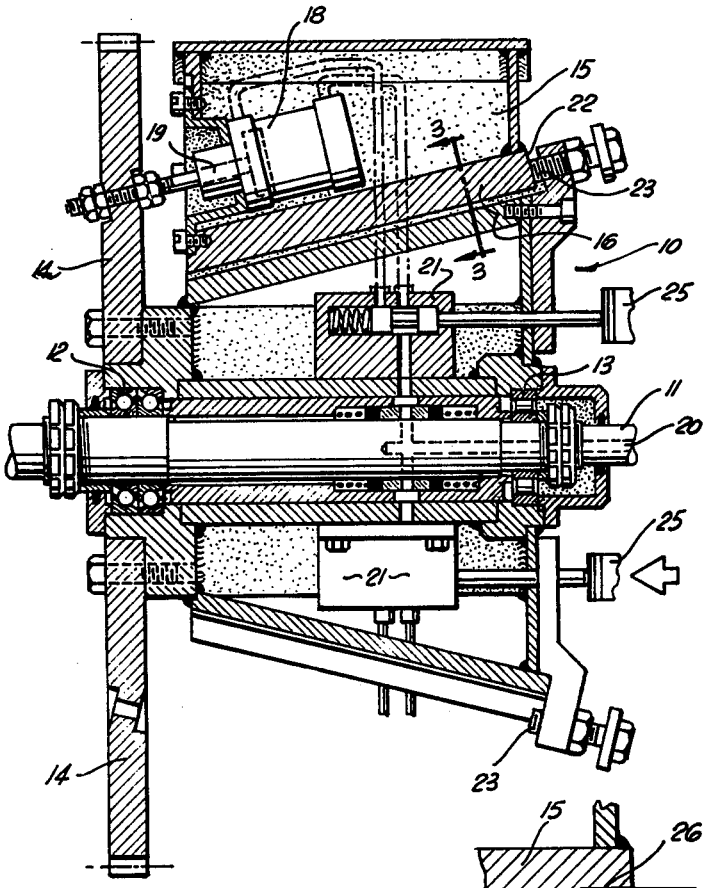
FIG. 2 is a sectional view taken on line 2—2 of FIG. 1.
Figure 3:
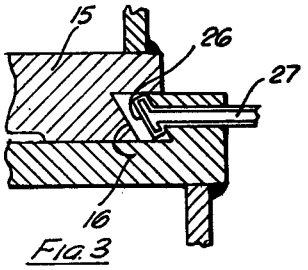
FIG. 3 is an enlarged section taken on line 3—3 of FIG. 2.

As best shown in FIG. 2, each carriage is provided with a double acting pneumatic cylinder end 18 having a ram end 19 rigidly connected to the gear 14. A constant source of air pressure is applied to passages 20 in the shaft 11 from which they communicate to the individual cylinders by pneumatic control valves 21 individual to each carriage. The air pressure within each cylinder 18 urges its respective carriage in a direction away from the gear 14 along its slide into a position of maximum radial extension as shown. In this position, an abutment face 22 on each carriage comes into contact with an adjustable stop 23. Individual screw adjustment of these stops ensures that the maximum radial displacement of each printing blanket can be accurately set to a predetermined datum reference such as circle 24. This individual adjustment facility ensures that any individual blanket can be removed from its carriage, replaced and adjusted without disturbing the accurate setting of the remaining blankets. Clearly, one or more new blankets can be installed and accurately positioned quite independently of the remaining ones.

Where it is required to retract one of the printing blankets to omit a specific printing function, a cam 25 is moved in the direction indicated by the arrow in FIG. 2, causing the respective pneumatic control valve 21 to alter the fluid supply to its cylinder 18 which then draws the required carriage 15 down its inclined slide towards the gear 14, thereby to retract the printing blanket radially inward towards the axis of the hub and out of printing engagement with the article stream. The printing blanket in question is then unable to apply ink to the damaged article or vacant mandrel as the case may be and only a single print application is lost. As the printing hub continues to rotate, the cam 25 is retracted to reverse the procedure and restore the printing blanket to its operative position once the damaged or absent article has been traversed. The amount of radial retraction required for the carriage may only be of the order of 3 or 4 mm.

Each carriage is held securely in its operative position by an elastomeric insert 26 supplied with air along a passage 27 communicating with each pneumatic control valve 21. Air pressure within the passage 27 causes the elastomeric element 26 to expand against the adjacent carriage slide 16, thereby to hold the carriage securely in position.

Although the invention has been described with reference to a specific example, it will be appreciated by those skilled in the art that the invention may be embodied in many other forms.

I claim:

1. Printing apparatus comprising:

a rotatably mounted hub having an outer periphery and a central portion, a plurality of printing blankets carried on said hub; each said blanket being mounted for separately controllable movement between an inoperative position radially inward of the outer periphery and an operative printing position at the outer periphery of said hub which is radially outward and axially offset from said inoperative position;

means for holding and moving said blankets inwardly and outwardly along a path of travel on said hub comprising a carriage for each blanket mounted within said hub at circumferentially spaced positions, a slide for each carriage extending diagonally radially and axially outwardly from the central portion of the hub toward the outer periphery thereof;

means to bias said carriages outwardly and actuate said carriages inwardly along their respective paths of travel comprising a separate fluid operated cylinder and ram assembly for each blanket carriage, a separate control valve and valve actuating means for each cylinder and a stop means on said paths to limit the travel of the carriages, defining said operative printing position;

said fluid operated cylinder assemblies each having a cylinder connected to said carriage and a ram directly connected to a drive gear extending radially outwardly from said hub.

2. Printing apparatus according to claim 1 wherein said stop means is adjustable thereby to adjust the radial location of said operative printing position.

3. Printing apparatus according to claim 1 wherein a cam controls fluid supply to said cylinders from said hub.

4. Printing apparatus according to claim 1 wherein means are provided for holding each said carriage against sliding motion.

* * * * *